US010727021B2

(12) United States Patent
Adachi et al.

(10) Patent No.: US 10,727,021 B2
(45) Date of Patent: Jul. 28, 2020

(54) ELECTRON EMISSION ELEMENT, ELECTRIFICATION APPARATUS, AND IMAGE FORMING APPARATUS

(71) Applicant: SHARP KABUSHIKI KAISHA, Sakai, Osaka (JP)

(72) Inventors: Katsumi Adachi, Sakai (JP); Hiroyuki Hirakawa, Sakai (JP); Tadashi Iwamatsu, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/316,026

(22) PCT Filed: Jul. 14, 2017

(86) PCT No.: PCT/JP2017/025690
§ 371 (c)(1),
(2) Date: Jan. 7, 2019

(87) PCT Pub. No.: WO2018/016433
PCT Pub. Date: Jan. 25, 2018

(65) Prior Publication Data

US 2019/0157033 A1 May 23, 2019

(30) Foreign Application Priority Data

Jul. 21, 2016 (JP) ..... 2016-143060

(51) Int. Cl.

| | |
|---|---|
| ***H01J 1/312*** | (2006.01) |
| ***H01J 1/304*** | (2006.01) |
| ***H01J 1/146*** | (2006.01) |
| ***H01J 1/144*** | (2006.01) |
| ***H01J 9/02*** | (2006.01) |
| ***H01J 29/04*** | (2006.01) |

(52) U.S. Cl.
CPC ..... *H01J 1/312* (2013.01); *H01J 1/144* (2013.01); *H01J 1/146* (2013.01); *H01J 1/304* (2013.01); *H01J 1/3048* (2013.01); *H01J 9/027* (2013.01); *H01J 29/04* (2013.01)

(58) Field of Classification Search
CPC ..... H01J 1/312; H01J 1/3048
See application file for complete search history.

(56) References Cited

U.S. PATENT DOCUMENTS

| | | | |
|---|---|---|---|
| 6,037,606 | A | 3/2000 | Ema |
| 2007/0216283 | A1 | 9/2007 | Kusunoki et al. |

FOREIGN PATENT DOCUMENTS

| | | | |
|---|---|---|---|
| JP | H01-298623 | A | 12/1989 |
| JP | H11-144607 | A | 5/1999 |
| JP | 2002-311684 | A | 10/2002 |
| JP | 2004-139762 | A | 5/2004 |
| JP | 2007-250219 | A | 9/2007 |

(Continued)

*Primary Examiner* — Farun Lu
(74) *Attorney, Agent, or Firm* — ScienBiziP, P.C.

(57) ABSTRACT

An electron emission element (20) includes a first electrode (30*a*) and a second electrode (40) which are arranged facing each other, an intermediate layer (50) that is provided between the first electrode (30*a*) and the second electrode (40), and an insulating layer (60) that is formed with a thickness d1 on a substrate (30). A level difference between the insulating layer (60) and the first electrode (30*a*) is smaller than the thickness d1 of the insulating layer (60).

10 Claims, 10 Drawing Sheets

(56) References Cited

FOREIGN PATENT DOCUMENTS

| | | | | |
|---|---|---|---|---|
| JP | 2014-007128 | A | | 1/2014 |
| JP | 2015-118853 | A | | 6/2015 |
| JP | 2015118853 | A | * | 6/2015 |

* cited by examiner

FIG. 8

| | MATERIAL OF INSULATING LAYER | STRUCTURE | INSULATING LAYER THICKNESS d1 | BORDER LEVEL DIFFERENCE d2 | INTERMEDIATE LAYER FILM THICKNESS d3 | EMISSION PROPERTY /STABILITY | d2/d3 | LIFE (BREAKAGE OF PERIPHERAL EDGE) |
|---|---|---|---|---|---|---|---|---|
| EXAMPLE 1-1 | ALUMITE | LEVEL DIFFERENCE IS REDUCED | 4 | 2 | 1.5 | ◎ | 1.3 | ◎ |
| EXAMPLE 1-2 | | | 4 | 2 | 0.7 | ○ | 2.9 | ○ |
| EXAMPLE 1-3 | | | 4 | 2 | 2.8 | ○ | 0.7 | ◎ |
| EXAMPLE 1-4 | | | 2 | 1 | 0.5 | ○ | 2.0 | ○ |
| EXAMPLE 1-5 | | | 2 | 1 | 1.3 | ◎ | 0.8 | ◎ |
| COMPARATIVE EXAMPLE 1-1 | | | 4 | 2 | 0.3 | △ | 6.7 | △ |
| COMPARATIVE EXAMPLE 1-2 | | | 4 | 2 | 5.2 | × | 0.4 | ○ |
| COMPARATIVE EXAMPLE 2-1 | ALUMITE | CONVENTIONAL | 4 | 5 | 1.5 | ◎ | 3.3 | △ |
| COMPARATIVE EXAMPLE 2-2 | | | 2 | 3 | 1.0 | ◎ | 3.0 | △ |
| COMPARATIVE EXAMPLE 2-3 | | | 4 | 5 | 1.0 | ◎ | 5.0 | × |
| COMPARATIVE EXAMPLE 2-4 | | | 4 | 5 | 5.4 | × | 0.9 | ○ |
| EXAMPLE 2-1 | RESIN FILM | LEVEL DIFFERENCE IS REDUCED | 4 | 2 | 1.3 | ◎ | 1.5 | ◎ |
| EXAMPLE 2-2 | | | 4 | 2 | 1.5 | ◎ | 1.3 | ◎ |
| EXAMPLE 2-3 | | | 6 | 4 | 1.5 | ◎ | 2.7 | ○ |
| COMPARATIVE EXAMPLE 3-1 | | | 4 | 2 | 0.6 | ○ | 3.3 | △ |

ELECTRON EMISSION ELEMENT, ELECTRIFICATION APPARATUS, AND IMAGE FORMING APPARATUS

TECHNICAL FIELD

The present invention relates to an electron emission element that applies voltage across electrodes arranged facing each other and emits electrons from one of the electrodes, an electrification apparatus that includes the electron emission element, and an image forming apparatus.

BACKGROUND ART

In recent years, a cold-cathode electron emission source has been applied to a field emission display or the like, and various forms such as an MIM type, an MIS type, a CNT type, a BSD type, a spindt type, and an SED type have been proposed (for example, refer to PTL 1). Various methods of creating a semiconductive layer that constitutes such an electron source have been proposed, and there is a method of applying resin solution, in which conductive particles are dispersed, as a simple creating process (for example, refer to PTL 2). Such a method has an advantage that it is possible to reduce costs of a manufacturing apparatus as an atmospheric process and an element is able to be created at a relatively low temperature by selecting resin.

FIG. 10 is a schematic structural view of a conventional electron emission element. In a conventional electron emission element 101, a semiconductive layer 104 serving as an electron acceleration layer is laminated on a substrate 102 having a first electrode, and a second electrode 105 serving as an electron emission surface is further formed on the semiconductive layer 104. Additionally, on the substrate 102, a region (insulating region RZ) where an insulating layer 103 with any pattern is formed is provided to be used for a wire 106 or the like. That is, a region exhibiting conductivity as an electron emission region RD by the semiconductive layer 104 directly contacting the substrate 102 and the insulating region RE are provided in the electron emission element 101. The electron emission element 101 includes a power supply 111 that is connected between the first electrode and the wire 106 and a ground power supply 112 that is connected between the first electrode and the power supply 111 and grounded. In the electron emission region RD of the electron emission element 101, irregularity may cause a case where an electric field is locally concentrated and insulation breakdown occurs or a case where an electron emission amount varies, so that it is important to manage a surface state.

The electron emission element 101 performs electron emission by applying voltage across the first electrode (surface of the substrate 102) and the second electrode 105, but at this time, current that flows through the element without contributing to electron emission is generated in some cases. Thus, it is desired that the insulating layer 103 that prevents electrons from flowing from the substrate 102 side is formed to suppress generation of unnecessary current in the element in a part (insulating region RZ) that is formed with the wire 106 or the like and does not involve in the electron emission. Moreover, in a case where a contact terminal or the like is brought into pressure contact with the wire 106 for power feeding, the insulating layer 103 preferably has a mechanically strong property so that no leakage current that flows to the substrate 102 through the wire 106, the second electrode 105, and the semiconductive layer 104 is generated.

As a method of forming the insulating layer 103, there are a method of forming a conductive thin film on an insulating region material such as glass, ceramic, or resin, a method of attaching an insulating sheet or the like onto a conductive substrate, and the like. For example, there is also a method that an aluminum substrate is anodized, an anodized film (hereinafter, also called an alumite film) in a region serving as an electron emission region RD is peeled off through etching or the like, and a conductor part is formed (for example, refer to PTL 3). This method has an advantage that the electron emission region RD and the insulating region RZ are able to be formed of the same material and manufacturing with relatively low costs is achieved, and additionally, the alumite film is excellent in insulating resistance and leakage resistance.

CITATION LIST

Patent Literature

PTL 1: Japanese Unexamined Patent Application Publication No. 1-298623

PTL 2: Japanese Unexamined Patent Application Publication No. 2014-7128

PTL 3: Japanese Unexamined Patent Application Publication No. 2015-118853

SUMMARY OF INVENTION

Technical Problem

However, it is found that the aforementioned method of peeling off the alumite film has a problem below. When the conductor part is formed through etching or the like and resin (coating liquid) serving as the semiconductive layer 104 is then applied on the substrate 102, a thin region of the semiconductive layer 104 is generated inside a level difference between the insulating layer 103 and the substrate 102.

In general, when the alumite film is grown until reaching a thickness of about 4 to 5 μm, the alumite film becomes a dense film having less defective part and is effective for preventing leakage generation. As described above, in order to peel off the alumite film and completely expose the conductor part, it is desirable to perform digging to be deeper than the thickness of the alumite film. Thus, the insulating region RZ and the electron emission region. RD have a level difference of about 5 to 6 μm generated due to the alumite film having the thickness of about 4 to 5 μm. In consideration of reduction of driving voltage, stable emission of electrons, or the like, the semiconductive layer 104 preferably has a film thickness of about 1 to 2 μm. When coating liquid of the semiconductive layer 104 is applied onto the substrate 102 that includes the insulating region RZ under such conditions, a coating film with a desired thickness is formed in a center of the electron emission region RD, and in an end of the electron emission region RD, a thick coating film is formed so as to cover a level difference with respect to the insulating layer 103. Here, in a region slightly inside the level difference, the coating film becomes locally thin, for example, due to an action of surface tension of the coating liquid. This becomes more conspicuous when the level difference is greater than the thickness of the coating film. In a region which is generated in this manner and in which the semiconductive layer 104 is thin, breakage of a surface electrode progresses first and a power feeding path of the element is damaged, thus causing reduction of emission current.

In a case where the thickness of the coating film is increased in order to avoid the foregoing, a defect such as an increase in the driving voltage or lowering of stability of emission is caused. Additionally, in a case where the thickness of the alumite film is reduced, the alumite film is insufficiently dense and an insulating property is reduced. Further, since a growth condition of alumite varies in a surface, when the alumite film is peeled off to expose the conductor part, irregularity is easily generated on the surface in which the conductor part is exposed and the conductor part has variation in a surface property, so that a defect may be caused in emission uniformity.

On the other hand, in a case where an anodized film is not used, for example, in a method of attaching an insulating sheet of a film shape, a mechanical strength of a resin film or the like is generally weaker than that of alumite, so that there is a difficulty in leakage resistance as the insulating layer 103, such as occurrence of a pinhole. When a thin film is used to avoid the level difference, the problem of the insulating property becomes more conspicuous. Further, there is also a problem that, in the attachment, a gap is generated between the insulating sheet and the substrate 102 so that the level difference is instable or a manufacturing process becomes complicated, so that costs are increased.

The invention is made to solve the aforementioned problems and an object thereof is to provide an electron emission element that is able to achieve a long life by preventing a reduction of a power feeding path due to progress of electrode breakage, an electrification apparatus and an image forming apparatus.

Solution to Problem

An electron emission element according to the invention is an electron emission element that applies voltage across a first electrode and a second electrode which are arranged facing each other and emits electrons from the second electrode, and includes: an intermediate layer that is provided between the first electrode and the second electrode; and an insulating layer that is formed with a thickness d1 on a substrate provided with the first electrode, in which a level difference d2 between the insulating layer and the first electrode is smaller than the thickness d1 of the insulating layer.

The electron emission element according to the invention may be configured such that the insulating layer is provided in a region of the substrate, which is lower than an upper surface of the first electrode.

The electron emission element according to the invention may be configured such that a film thickness d3 of the intermediate layer satisfies $d2<3\times d3$.

The electron emission element according to the invention may be configured such that a film thickness d3 of the intermediate layer satisfies $0.3\ \mu m<d3<5\ \mu m$.

The electron emission element according to the invention may be configured such that the substrate is formed of a metal material, and the insulating layer is an anodized film.

The electron emission element according to the invention may be configured such that the substrate is formed of aluminum.

The electron emission element according to the invention may be configured such that the insulating layer is formed after the substrate is subjected to surface processing.

The electron emission element according to the invention may be configured such that a surface roughness Ra of the first electrode satisfies $0.05\ \mu m<Ra<0.8\ \mu m$.

An electrification apparatus according to the invention Includes the electron emission element according to the invention as an electron emission source.

An image forming apparatus according to the invention includes the electrification apparatus according to the invention.

Advantageous Effects of Invention

According to the invention, by reducing a level difference between a conductor part which functions as an electrode and an insulating layer while securing a necessary thickness of the insulating layer, it is possible to prevent reduction of a power feeding path due to progress of electrode breakage and achieve a long life.

BRIEF DESCRIPTION OF DRAWINGS

FIG. 8 is a characteristic chart illustrating evaluation conditions and evaluation results.

DESCRIPTION OF EMBODIMENTS

First Embodiment

An electrification apparatus according to a first embodiment of the invention will be described below with reference to drawings.

Figure 1:
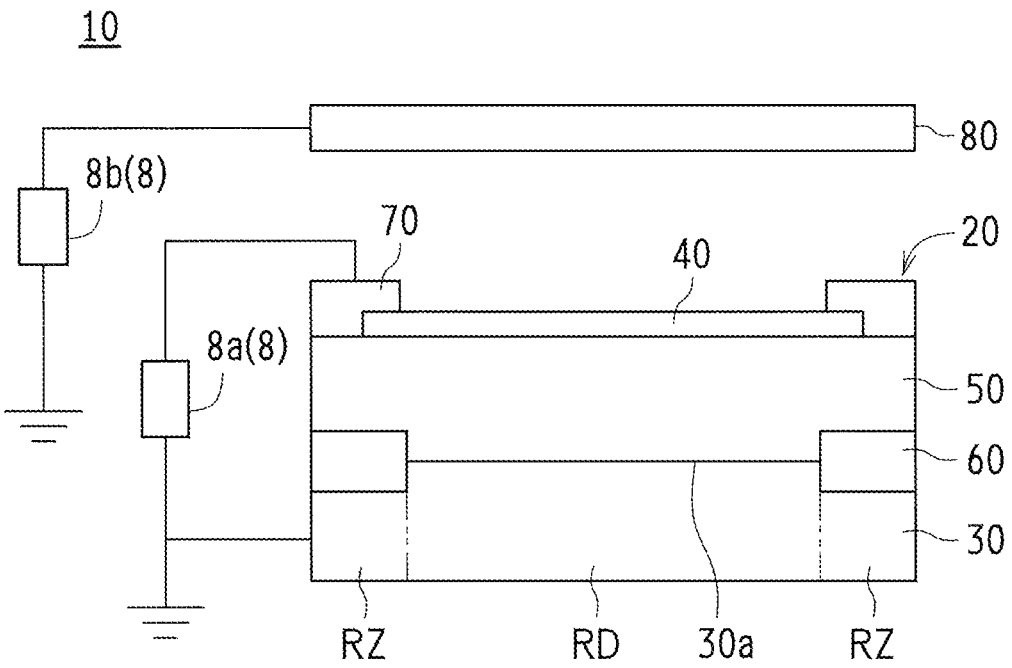
FIG. 1 is a schematic side view of an electrification apparatus according to a first embodiment of the invention.

FIG. 1 is a schematic side view of the electrification apparatus according to the first embodiment of the invention.

An electrification apparatus 10 according to the first embodiment of the invention includes an electron emission. element 20 that has a first electrode 30*a* and a second electrode 40 which are arranged facing each other, an intermediate layer 50 provided between the first electrode 30*a* and the second electrode 40, and an insulating layer 60 formed on a substrate 30 provided with the first electrode 30*a*, and applies voltage across the first electrode 30*a* and the second electrode 40 and emits electrons from the second electrode 40.

The electrification apparatus 10 also includes a first power supply 8*a* (a part of a power supply unit 8) that applies voltage across the first electrode 30*a* and the second electrode 40. The electrification apparatus 10 further includes a third electrode 80 that is arranged facing the electron emission element 20 (particularly, second electrode 40) and a second power supply 8*b* (a part of the power supply unit 8) that applies voltage to the third electrode 80. The electrons emitted from the electron emission element 20 are attracted by an electric field of the third electrode 80 and collected, or given acceleration. energy in a vacuum. Note that, in a case where the electrification apparatus 10 is applied to an image forming apparatus, a photoreceptor drum corresponds to the third electrode 80.

Specifically, in the electron emission element 20, the insulating layer 60, the intermediate layer 50, the second electrode 40, and a wire electrode 70 are laminated in order on the first electrode 30*a* provided on a surface of the substrate 30.

The substrate 30 is an electrode substrate particularly a surface of which also functions as, the first electrode 30*a*, and is constituted by a plate body having conductivity. In the present embodiment, the substrate 30 is formed of an aluminum material (t0.5 mm, A1000 system, BF finish, manufactured by Sumitomo Light Metal Industries, Ltd.). Note that, the substrate 30 is only required to have secured conductivity and one obtained by forming a conductive thin film (first electrode 30*a*) on an insulating substrate made from ceramic, glass, or the like may be used.

The insulating layer 60 is formed of a material having an insulating property, is provided in a part of a region of the electron emission element 20, and blocks current flowing from the first electrode 30*a* to the second electrode 40. In the present embodiment, the insulating layer 60 is provided along a peripheral edge of the electron emission element 20. That is, on the substrate 30, an opening of a rectangular shape is formed by the insulating layer 60, and a region inside the opening is an electron emission region RD in. which the first electrode 30*a* is exposed and a region outside the opening is an insulating region RZ in which the substrate 30 is covered with the insulating layer 60. Moreover, the insulating layer 60 is provided in a region of the substrate 30, which is lower than an upper surface of the first electrode 30*a*. Thus, a structure in which a lower end of the insulating layer 60 is provided to be lower than the upper surface of the first electrode 30*a* is provided, so that it is possible to easily reduce a level difference between the insulating layer 60 and the first electrode 30*a*. Note that, a structure of the substrate 30 and the insulating layer 60 will be specifically described with reference to FIGS. 2A through 2D described below.

The intermediate layer 50 is laminated on the entire electron emission element 20. Thus, the intermediate layer 50 is laminated on the insulating layer 60 in a region where the insulating layer 60 is provided and laminated on the first electrode 30*a* in the other region. Note that, though the intermediate layer 50 is laminated on the entire electron emission element 20 in the present embodiment, there is no limitation thereto and a part of the insulating layer 60 at an end of the substrate 30 may be exposed.

In the present embodiment, the intermediate layer 50 is constituted by resin and conductive fine particles dispersed in the resin. The resin is, for example, silicone resin. obtained through polycondensation of silanol ($R_3Si$—OH). As the conductive fine particles, metal particles having conductivity, for example, such as gold, silver, platinum, or palladium, may be used. Moreover, as a conductive material other than metal particles, carbon, conductive polymers, a semiconductive material, or the like may be used. A content of the conductive fine particles in the intermediate layer 50 may be set as appropriate and a resistance value of the intermediate layer 50 is able to be adjusted in accordance with the content. The intermediate layer 50 is formed by an application method such as a spin coating method, a doctor blade method, a spray method, or a dipping method.

According to a method of creating the intermediate layer 50 in the present embodiment, first, 3 g of silicone resin (room temperature-curable resin, manufactured by Shin-Etsu Silicones) that is resin and 0.03 g of Ag nanoparticles (average diameter of 10 nm, 1 nm of an insulating coating film with alcoholate, manufactured by Nanoparticle Laboratory Corporation) that are conductive fine particles are put into a reagent bottle and mixed, and mixture liquid is thereby created. Then, by further stirring the mixed liquid, which is put into the reagent bottle, with use of an ultrasonic vibrator, coating liquid is created. Viscosity of the coating liquid suitable for spray coating and spin coating is 0.8 to 15 mPa·S. A ratio of resin components in the coating liquid is about 10 to 70 wt % and may be appropriately adjusted to achieve an optimum condition by using a diluent solvent or the like. After being applied to the substrate 30, the coating liquid is subjected to polycondensation by moisture in the atmosphere and becomes silicone resin, so that the intermediate layer 50 is formed.

The second electrode 40 may be formed by using an existing method and is formed by using a magnetron sputtering apparatus in the present embodiment. In the present embodiment, the second electrode 40 is formed by Au—Pd, and has a film thickness of 50 nm and an electrode area of 49 $mm^2$. Note that, when the thickness of the second electrode 40 is reduced, efficiency of electron emission is improved, but a film resistance increases to cause a voltage drop or the second electrode 40 is easily broken due to heat or mechanical wear. When the thickness is increased, the electrons are trapped by the second electrode 40 and an amount of electrons emitted to outside is reduced, and efficiency of electron emission is reduced. In such a case, the film thickness may be appropriately adjusted in accordance with a material or the like, but the second electrode 40 preferably has a smaller film thickness.

The wire electrode 70 is formed of a conductive material. Note that, without providing the wire electrode 70, a power feeding terminal may be brought into contact with the second electrode 40 to perform power feeding.

As described above, when used as an electron emission source of the electrification apparatus 10, the electron emission element 20 is preferably arranged to be separated from a photoreceptor (third electrode 80), for example, by about 0.5 to 1.5 mm. Moreover, it is preferable that voltage applied to the electron emission element 20 is 20 to 25 V and a frequency is a pulse wave of 1 to 2 kHz. The power supply unit 8 is adjusted so that electrons with 5 $\mu A/cm^2$ per unit area are emitted by adjusting a duty ratio and a voltage value, the electron emission element 20 faces a metal flat plate. Under such a condition, the photoreceptor is controlled to rotate with a rotation peripheral speed of 225 mm/s and have a surface with −400 to 600 V. The electrification apparatus 10 described above is able to efficiently perform electrification without discharge or without generation of ozone harmful to a human body.

Next, a step of forming the insulating layer 60 on the substrate 30 will be described with reference to FIGS. 2A through 2D.

Figure 2A:
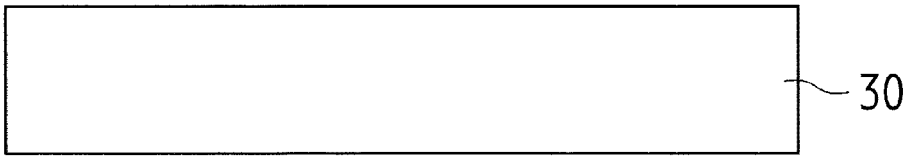
FIG. 2A is an explanatory view illustrating a substrate subjected to surface processing.

FIG. 2A is an explanatory view illustrating the substrate subjected to surface processing.

The substrate 30 has a surface subjected to etching processing by using a commercially available aluminum material as described above and is adjusted to have a desired surface roughness. That is, various commercially-available aluminum materials have a surface with irregularity due to rolling streaks generated during manufacturing or exposure or dissociation of contained impurities, and great irregularity causes a defect in subsequent formation of the intermediate layer 50 or element characteristics in some cases. That is, when the surface of the substrate is too rough, the intermediate layer varies in a substantial film thickness, and due to a fluctuation of electric field intensity inside the electron emission element, a problem of a nonuniform state of electron emission or generation of leakage of current is caused. When the surface is excessively flattened, an adhesive property with a protection film HM described below is lowered and a defect may be caused in patterning of the insulating layer 60. In consideration of the foregoing, the surface roughness of the substrate 30 is desired to have about 0.05 to 0.8 μm as an arithmetic average roughness Ra (JIS B 0601 (1994)). In this manner, by setting an optimum surface roughness of the substrate 30, it is possible to stabilize an emission property.

Figure 2B:
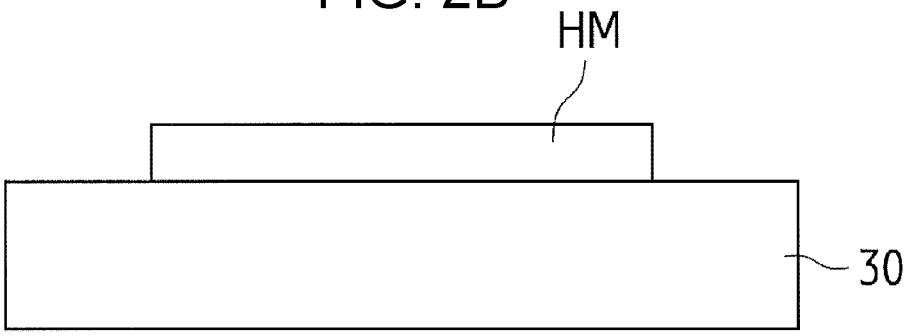
FIG. 2B is an explanatory view illustrating a step of forming a protection film on the substrate.

FIG. 2B is an explanatory view illustrating a step of forming a protection film on the substrate.

FIG. 2B illustrates a state where the protection film HM is formed on the substrate 30 illustrated in FIG. 2A. The protection film HM has a given pattern formed by photolithography, screen printing, or the like, and is provided on a part corresponding to the electron emission region RD out of the substrate 30. That is, a part corresponding to the insulating region RZ is not covered with the protection film HM and has the substrate 30 exposed.

Figure 2C:
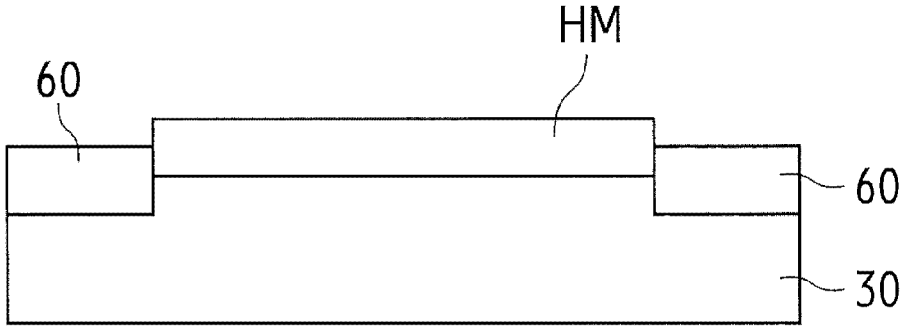
FIG. 2C is an explanatory view illustrating a step of forming an insulating layer on the substrate.

FIG. 2C is an explanatory view illustrating a step of forming the insulating layer on the substrate.

FIG. 2C illustrates a state where the insulating layer 60 is formed on the substrate 30 illustrated in FIG. 2B. By applying anodizing processing while the electron emission region RD is covered with the protection film HM, the insulating layer 60 is formed only in the insulating region RZ. Here, since an anodized film grows isotropically toward an outside and an inside of an original metal surface, the lower end of the insulating layer 60 is at a position lower than an upper surface of the substrate 30 and an upper end of the insulating layer 60 is at a position higher than the upper surface of the substrate 30. At this time, an oxidation film may be formed on a back surface (surface opposite to the first electrode 30*a*) of the substrate 30 or the back surface may be also applied with the protection film NM to remain being a conductor. This may be appropriately selected by considering a countermeasure against warping in a case of a temperature change caused by an area difference between a front side and a back side of an alumite film, restriction in a power feeding structure, or the like.

Figure 2D:
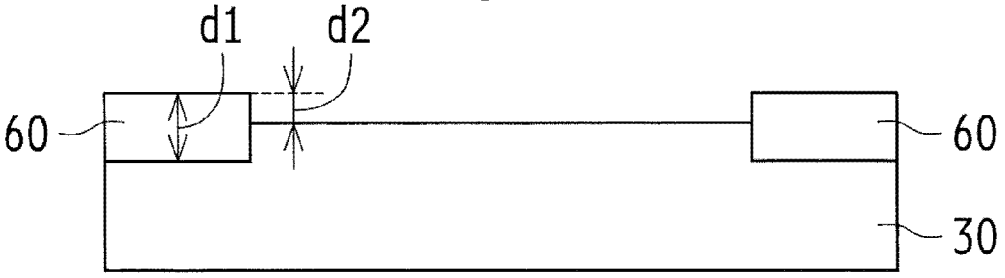
FIG. 2D is an explanatory view illustrating a step of removing the protection film from the substrate.

FIG. 2D is an explanatory view illustrating a step of removing the protection film from the substrate.

FIG. 2D illustrates a state where the protection film HM is removed from the substrate illustrated in FIG. 2C. By removing the protection film HM, a given pattern of the insulating layer 60 is formed and the first electrode 30*a* (substrate 30) is exposed. As described above, as a result of the isotropic growth of the anodized a level difference between the insulating layer 60 and the first electrode 30*a* becomes smaller than a thickness of the insulating layer 60 and is about half the thickness. Note that, hereinafter, for simplification of description, the level difference between the insulating layer 60 and the first electrode 30*a* is called a border level difference d2 and the thickness of the insulating layer 60 is called an insulating layer thickness d1 in some cases.

Figure 3:
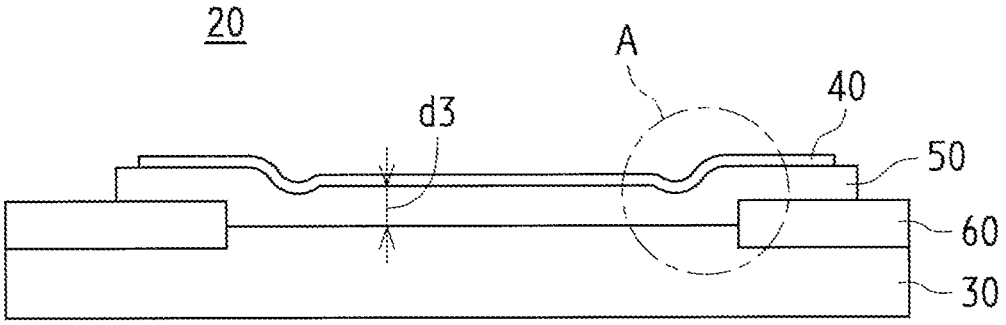
FIG. 3 is a schematic sectional view of an electron emission element according to the first embodiment of the invention.

FIG. 3 is a schematic sectional view of the electron emission element according to the first embodiment of the invention. Note that, in FIG. 3, hatching is omitted in consideration of visibility of the figure.

In FIG. 3, on the substrate 30 that has the insulating layer 60 created through the steps illustrated in FIGS. 2A through 2D, the intermediate layer 50 and the second. electrode 40 are formed. As described above, in a region slightly inside the level difference between the insulating layer 60 and the first electrode 30*a*, the film thickness of the intermediate layer 50 is slightly reduced to such an extent that does not affect emission of electrons. Hereinafter, for description, the film thickness of the intermediate layer 50 is called an intermediate layer film thickness d3 in some cases.

The intermediate layer film thickness d3 is appropriate when it is 0.3 to 5 μm, and is more desirably 0.5 to 3 μm. When the intermediate layer film thickness d3 is reduced, it is concerned that the film thickness in a vicinity of the level difference of the insulating layer 60 is reduced, so that the border level difference d2 needs to be reduced, but the reduction of the intermediate layer film thickness d3 causes a trouble in stability as the insulating layer 60. On the other hand, when the intermediate layer film thickness d3 is increased, element driving voltage used for performing electron emission becomes high and an insulating property needs to be secured by increasing the thickness of the insulating layer 60. As a result, a thermal stress is applied to the substrate 30, for example, due to heat generation during driving of the element, and cracking or peeling-off due to a difference of a physical property between the insulating layer 60 and a conductor part is concerned. Thus, the aforementioned configuration is effective for securing the insulating property, stabilization of the level difference, and further, reduction in the element driving voltage, or reduction in manufacturing costs of the substrate.

Next, for comparison, a conventional example in which an insulating layer is formed by a conventional method will be described with reference to drawings.

Figure 4A:
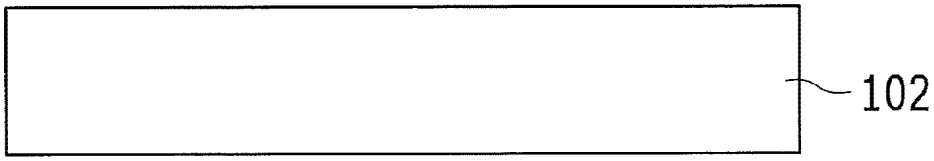
FIG. 4A is an explanatory view illustrating a substrate of a conventional example.

FIG. 4A is an explanatory view illustrating a substrate of the conventional example.

In an electron emission element 101 of the conventional example, a substrate 102 similar to that of the first embodiment is used. Note that, whether or not to perform surface processing may be appropriately selected.

Figure 4B:
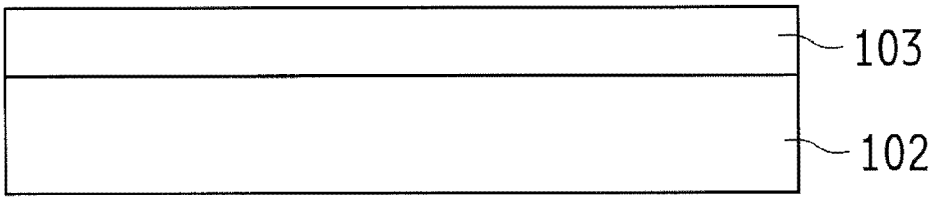
FIG. 4B is an explanatory view illustrating a step of forming an insulating layer in the conventional example.

FIG. 4B is an explanatory view illustrating a step of forming the insulating layer in the conventional example.

FIG. 4B illustrates a state where an insulating layer 103 is formed on the substrate 102 illustrated in FIG. 4A. In the conventional example, differently from the first embodiment, the insulating layer 103 is uniformly formed on the entire substrate 102.

Figure 4C:
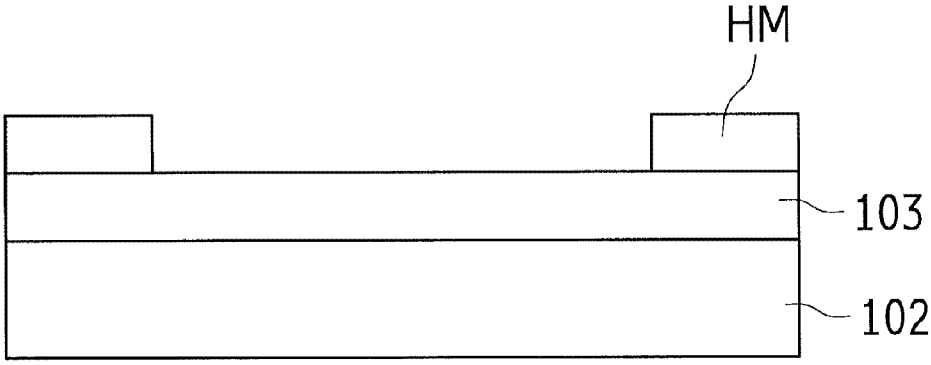
FIG. 4C is an explanatory view illustrating a step of forming a protection film in the conventional example.

FIG. 4C is an explanatory view illustrating a step of forming the protection film in the conventional example.

FIG. 4C illustrates a state where the protection film NM is formed on the insulating layer 103 illustrated in FIG. 43. In the conventional example, the protection film NM is provided in a part corresponding to the insulating region RZ and the insulating layer 103 is exposed in the electron emission region RD.

Figure 4D:
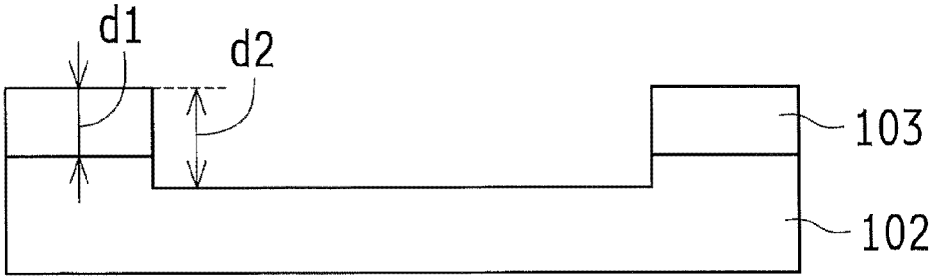
FIG. 4D is an explanatory view illustrating a step of etching the insulating layer in the conventional example.

FIG. 4D is an explanatory view illustrating a step of etching the insulating layer in the conventional example.

In FIG. 4D, by performing etching for the substrate 102 illustrated in FIG. 4C, the insulating layer 103 in the electron emission region RD is stripped, and then, the protection film HM is removed. When the insulating layer 103 is stripped, the substrate 102 needs to be etched to be deeper than a thickness of the insulating layer 103 by about 1 to 2 μm by considering variation in growth of an alumite film, which is caused by irregularity of the substrate 102 or contained impurities. Thus, the border level difference d2 is larger than the insulating layer thickness d1 in the conventional example. When the insulating layer thickness d1 is 2 to 4 μm, the border level difference d2 is about 3 to 6 μm.

Figure 5:
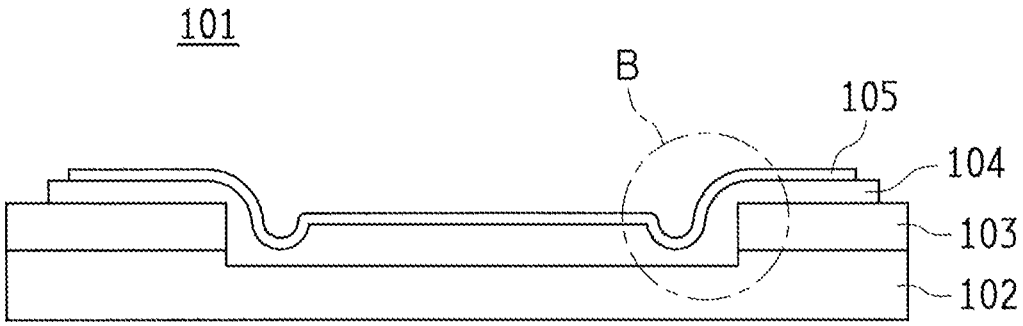
FIG. 5 is a schematic sectional view of an electron emission element of the conventional example.

FIG. 5 is a schematic sectional view of as electron emission element of the conventional example. Note that, in FIG. 5, hatching is omitted in consideration of visibility of the figure.

In FIG. 5, on the substrate 102 that has the insulating layer 103 created through the steps illustrated in FIGS. 4A through 4D, a semiconductive layer 104 (intermediate layer) and a second electrode 105 are formed. In the conventional example, differently from the first embodiment illustrated in FIG. 3, in a region slightly inside a level difference between the insulating layer 103 and the first electrode, a thickness of the semiconductive layer 104 is extremely reduced. That is, in a case where the level difference is greater than the film thickness of the semiconductive layer 104, a coating film is concentrated on an edge of the level difference to increase the film thickness. In a center of the electron emission region RD, the coating film is flattened due to an action of surface tension so as to keep the film thickness fixed. At this time, a part of the coating film between the edge and the center is extended from both sides and becomes thin. As a result, a locally thin part is generated in the semiconductive layer 104.

Next, evaluation results for the electron emission element 20 according to the first embodiment and the electron emission element 101 of the conventional example will be described. In each evaluation, after performing an aging test of the electron emission property of the electron emission element 20 that is created, a surface state is observed.

Figure 6:
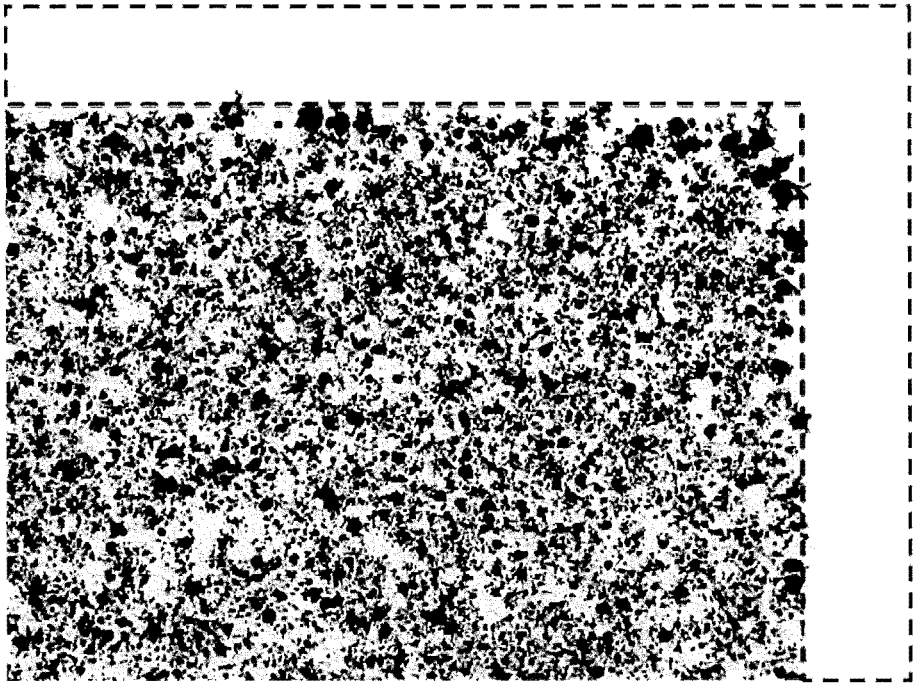
FIG. 6 is a surface view illustrating a vicinity of a reference sign A of the electron emission element illustrated in FIG. 3.
Figure 7:
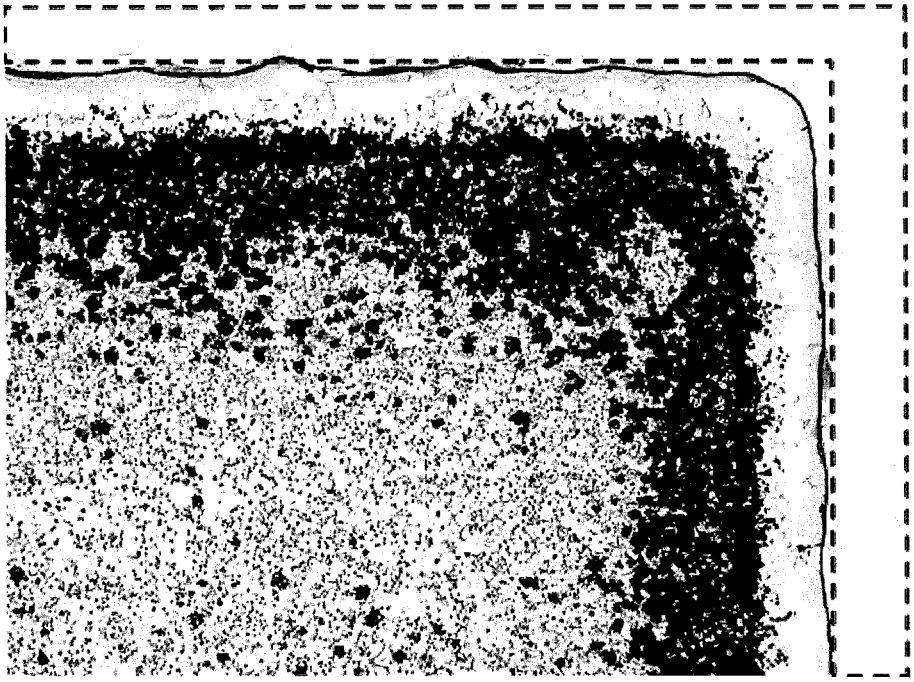
FIG. 7 is a surface view illustrating a vicinity of a reference sign B of the electron emission element illustrated in FIG. 5.

FIG. 6 is a surface view illustrating a vicinity of a reference sign A of the electron emission element illustrated in FIG. 3 and FIG. 7 is a surface view illustrating a vicinity of a reference sign B of the electron emission element illustrated in FIG. 5.

FIGS. 6 and 7 each illustrate an enlarged image obtained by photographing a part of a surface of each of the elements and each broken line in the figures indicates the insulating region RZ (an upper side and a right side in the figures). In each of the elements, a damaged part of the second electrode 40 (second electrode 105) is blackened by emission of electrons. As illustrated in FIG. 6, in the electron emission element 20 according to the first embodiment, intensive breakage of the second electrode 40 is not found and uniform electron emission continues over the entire electron emission region RD. On the other hand, in the conventional example illustrated in FIG. 7, considerable breakage of a surface electrode progresses at a part about 100 to 200 μm inside from a border of the insulating region RZ. As electron emission characteristics at this time, not only emission current but also current in the element that flows across the first electrode on the substrate 102 side and the second electrode 105 on the surface side are reduced. In the electron emission element 101, power is fed from the second electrode 105 provided in the insulating region RZ, but the current in the element flows along the second electrode 105 and a power feeding path is considerably eliminated due to breakage of the surface electrode, so that the current in the element and the emission current are considered to be reduced. On the center side of the electron emission region RD, breakage of the surface electrode hardly progresses and a state where continuous usage is allowed is provided, but a life of the element ends due to electrode breakage near the level difference of the insulating layer 103.

As described above, in the present embodiment, the border level difference d2 is smaller than the insulating layer thickness d1, so that it is possible to suppress local reduction of the film thickness in a vicinity of the level difference while securing the necessary thickness of the insulating layer 60 and prevent reduction of the power feeding path due to progress of the electrode breakage, thus achieving a long life.

Moreover, in the present embodiment, the insulating region RZ that is a part of the substrate 30 is anodized and the insulating layer 60 is formed. The anodized film grows towards both sides of a material surface in a height direction. That is, since a configuration in which the insulating layer 60 grows under the surface of the substrate 30 is provided, it is possible to form a small level difference while securing a necessary thickness of the insulating layer 60. Moreover, since a part other than the insulating layer 60 in the substrate 30 serves as the electron emission region RD corresponding to the first electrode 30*a*, the electron emission region RD and the insulating region R are able to be formed of a single material and it is possible to easily achieve cost reduction. Meanwhile, in a case where the electron emission region RD is anodized, it is concerned that irregularity is caused in a peeled surface that is generated when the anodized film is peeled off to expose the surface. In the present embodiment, however, the insulating layer 60 is able to be formed without forming the anodized film in the electron emission region RD, so that it is possible to stabilize a surface property of the electrode surface to contribute to stabilization of emission characteristics.

Since aluminum that is a material of the substrate 30 is relatively inexpensive and an alumite film serving as an oxidation film is strong, it is possible to avoid leakage generation due to a mechanical damage to the insulating layer 60. Note that, the material of the substrate 30 is not limited to aluminum and may be a material by which an anodized film is able to be formed, such as titanium, magnesium, nickel, or a stainless steel plate.

In the present embodiment, the insulating layer 60 is formed after the substrate 30 is subjected to surface processing. In the conventional method, there is a case where a defect is caused in processing of the insulating layer 60 or an action on the electron emission region RD depending on the surface property of the substrate 30. Then, by applying the surface processing to the substrate 30 before the anodizing processing, the insulating layer 60 is able to be stably formed. Moreover, when the surface property of the electron emission region RD covered with the protection film HM is adjusted again after the anodized film is formed, an increase in the level difference is concerned, but the aforementioned configuration makes it possible to achieve both a desired surface property and desired formation of a level difference.

Second Embodiment

Next, an electron emission element according to a second embodiment will be described. Note that, since the second embodiment has an almost similar configuration to that of the first embodiment, a drawing will be omitted and a component having a function substantially equivalent to that of the first embodiment will be given the same reference sign and description thereof will be omitted.

The second embodiment is different from the first embodiment in a step of forming the insulating layer 60. Specifically, in the substrate 30, only the insulating region RZ is dug by a chemical action or a mechanical method, and in the dug part, the insulating layer 60 formed of a resin film, ceramic, or glass is provided.

Evaluation Results

Next, results of evaluating as electron emission property and a degree of breakage of a peripheral edge of the electron emission region RD in the first embodiment, the conventional example, and the second embodiment will be indicated.

FIG. 8 is a characteristic chart illustrating evaluation conditions and evaluation results.

In the evaluation, a plurality of samples are created for the first embodiment, the conventional example, and the second embodiment by changing the insulating layer thickness d1, the border level difference d2, and the intermediate layer film thickness d3. Note that, hereinafter, for simplification of description, the electron emission property is abbreviated as an "emission property" and the degree of breakage of the peripheral edge of the electron emission region RD is abbreviated as a "life".

The samples for Example 1-1 through Example 1-5, Comparative example 1-1, and Comparative example 1-2 are created by a method similar to that of the first embodiment. That is, the insulating layer 60 is an alumite film and a structure in which the level difference is reduced as in FIG. 3 is provided. The insulating layer thickness d1 is 4 μm and the border level difference d2 is 2 μm in Example 1-1 through Example 1-3. The intermediate layer film thickness d3 is 1.5 μm in Example 1-1, 0.7 μm in Example 1-2, and 2.8 μm in Example 1-3. The insulating layer thickness d1 is 2 μm and the border level difference d2 is 1 μm in Example 1-4 and Example 1-5. The intermediate layer film thickness d3 is 0.5 μm in Example 1-4 and 1.3 μm in Example 1-5. The insulating layer thickness d1 is 4 μm and the border level difference d2 is 2 μm in Comparative example 1-1 and Comparative example 1-2. The intermediate layer film thickness d3 is 0.3 μm in Comparative example 1-1 and 5.2 μm in Comparative example 1-2. The evaluation results of Example 1-1 through Example 1-5 indicate that both of the emission property and the life are excellent. On the other hand, the evaluation results of Comparative example 1-1 and Comparative example 1-2 indicate that any or both of the emission property and the life are poor.

The samples for Comparative example 2-1 through Comparative example 2-4 are created by a method similar to that of the conventional example. That is, the insulating layer 60 is an alumite film and a conventional structure as in FIG. 5 is provided. The insulating layer thickness d1 is 2 μm and the border level difference d2 is 3 μm only in Comparative example 2-2 out of Comparative example 2-1 through Comparative example 2-4, and the insulating layer thickness d1 is 4 μm and the border level difference d2 is 5 μm in the others. The intermediate layer thickness d3 is 1.5 μm in Comparative example 2-1, 1.0 μm in Comparative example 2-2 and Comparative example 2-3, and 5.4 μm in Comparative example 2-4. The evaluation results in Comparative example 2-1 and Comparative example 2-4 indicate that any or both of the emission property and the life are poor.

The samples for Example 2-1 through Example 2-3 and Comparative example 3-1 are created by a method similar to that of the second embodiment. That is, the insulating layer 60 is a resin film and a structure in which the level difference is reduced as in FIG. 3 is provided. The insulating layer thickness d1 is 4 μm and the border level difference d2 is 2 μm in Example 2-1 and Example 2-2. The insulating layer thickness d1 is 6 μm and the border level difference d2 is 4 μm in Example 2-3. The insulating layer thickness d1 is 4 μm and the border level difference d2 is 2 μm in Comparative example 3-1. The intermediate layer film thickness d3 is 1.3 μm in Example 2-1, 1.5 μm in Example 2-2 and Example 2-3, and 0.6 μm in Comparative example 3-1. The results of Example 2-1 through Example 2-3 indicate that both of the emission property and the life are excellent and the result of Comparative example 3-1 indicates that the life is poor.

As found from a relationship between the results of the emission property described above and the intermediate layer film thickness d3, leakage generation is caused when the intermediate layer film thickness d3 is less than 0.3 μm, and shortage of an emission amount is caused when the intermediate layer film thickness d3 is 5.0 μm or more. Further, in order to evaluate a relationship between the border level difference d2 and the intermediate layer film thickness d3, a value of "d2/d3" is calculated. As found from a relationship between the results of the life (breakage of the peripheral edge) and "d2/d3", an excellent result is obtained when the value of "d2/d3" is less than 3. That is, the intermediate layer film thickness d3 is desired to satisfy $d2<3\times d3$. When the border level difference d2 is too great with respect to the intermediate layer film thickness d3, the film thickness is easily reduced in a vicinity of the level difference of the insulating layer 60. Therefore, by setting the intermediate layer film thickness d3 in an appropriate range, it is possible to suppress a degree of the reduction of the film thickness.

Third Embodiment

Figure 9:
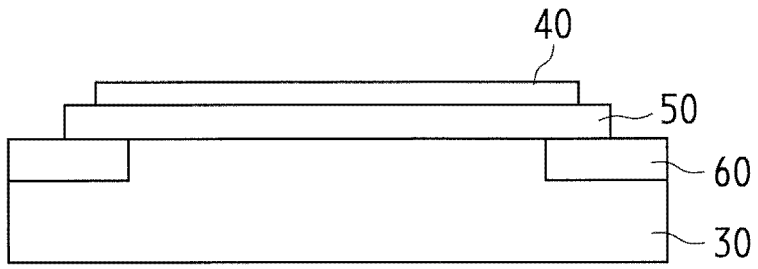
FIG. 9 is a schematic sectional view of an electron emission element according to a third embodiment of the invention.
Figure 10:
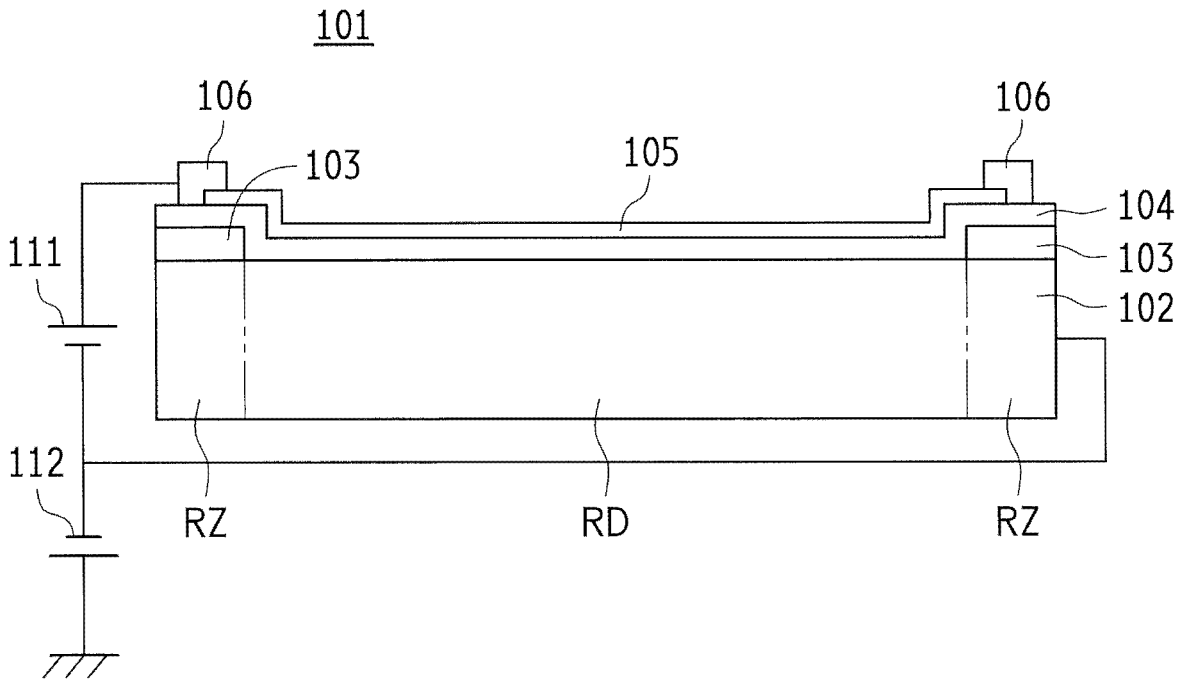
FIG. 10 is a schematic structural view of a conventional electron emission element.

FIG. 9 is a schematic sectional view of an electron emission element according to a third embodiment of the invention. Note that, since the third embodiment has an almost similar configuration to that of the first embodiment, a component having a function substantially equivalent to those of the first embodiment and the second embodiment will be given the same reference sign and description thereof will be omitted.

The third embodiment is different from the first embodiment in a shape of the insulating layer 60. Specifically, in the third embodiment, the upper end of the insulating layer 60 and the upper surface of the substrate 30 are substantially matched in height. That is, in the third embodiment, a structure in which there is no level difference between the insulating layer 60 and the first electrode 30*a* is provided and the border level difference d2 is 0 μm. When the insulating layer 60 is formed by anodizing processing as in the first embodiment, the height may be adjusted by digging only the insulating layer 60, or when the insulating layer 60 is provided by attachment as in the second embodiment, a depth at which the substrate 30 is dug and a thickness of a resin film or the Like may be adjusted in advance. The structure without a level difference makes it possible to suppress a fluctuation in the film thickness of the intermediate layer 50.

Fourth Embodiment

Figure 11:
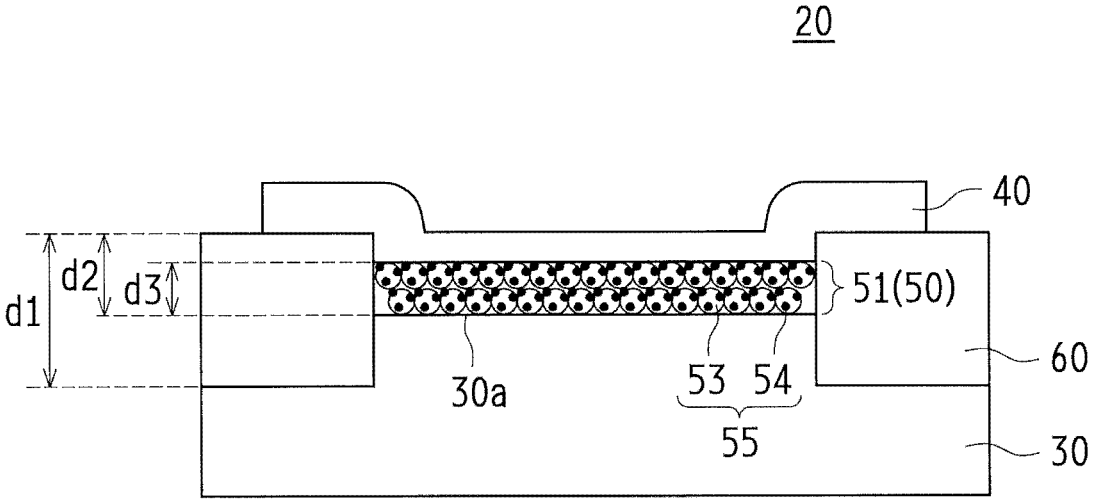
FIG. 11 is a schematic sectional view of an electron emission element according to a fourth embodiment of the invention.

FIG. 11 is a schematic sectional view of an electron emission element according to a fourth embodiment of the invention. Note that, since the fourth embodiment has an almost similar configuration to that of the first embodiment, a component having a function substantially equivalent to those of the first embodiment through the third embodiment will be given the same reference sign and description thereof will be omitted.

The fourth embodiment is different from the first embodiment in a configuration of the intermediate layer 50. Specifically, in the present embodiment, the intermediate layer 50 is a fine particle layer 51 constituted by insulating fine particles 53 and conductive fine particles 54 and is provided in an opening of the insulating layer 60, and the first electrode 30*a* is covered with the intermediate layer 50.

The fine particle layer 51 is preferably constituted by support particles 55 in which the conductive fine particles 54 are supported on the insulating fine particles 53 and a secondary particle diameter of the insulating fine particles 53 is preferably greater than a particle diameter of the conductive fine particles 54. In fine particles such as the insulating fine particles 53 and the conductive fine particles 54, a size in a dispersed state is set as a primary particle diameter and a size in an aggregated state is set as a secondary particle diameter.

The insulating fine particles 53 preferably have an average secondary particle diameter of 0.05 μm to 5.0 μm. That is, in a case where the average secondary particle diameter of the insulating fine particles 53 is less than 0.05 μm, it is difficult to support the conductive fine particles 54, and in a case where it is greater than 5.0 μm, the film thickness of the intermediate layer 50 is too large, which is not preferable. Moreover, an average primary particle diameter of the insulating fine particles 53 is preferably 1 nm to 1000 nm, more preferably 5 nm to 400 nm, and much more preferably 20 nm to 200 nm.

As a material of the insulating fine particles 53, a metal oxide such as silicon oxide, aluminum oxide, titanium oxide, tungsten oxide, barium titanate, strontium titanate, sodium tantalate tin oxide, zinc oxide, zirconium. oxide, or manganese oxide, a tantalic (niobium) oxynitride containing transition metal such as $LaTiO_2N$, $CaTaO_2N$, $SrTaO_2N$, $BaTaO_2N$, $LaTaON_2$, $CaNbO_2N$, $SrNbO_2N$, $BaNbO_2N$, or $LaNbON_2$, an oxynitride such as tantalum oxynitride, a nitride such as aluminum nitride, gallium nitride, or tantalum nitride, a sulfide such as cadmium sulfide, or the like is usable.

In particular, a material of the insulating fine particles 53 having a photocatalytic function may be a semiconductor material and is preferably a metal oxide, an oxynitride, a nitride, or a sulfide having a photocatalytic function. As the material of the insulating fine particles 53, for example, titanium oxide ($TiO_2$), barium titanate ($BaTiO_3$), strontium titanate ($SrTiO_3$), tungsten oxide ($WO_3$), sodium tantalite ($NaTaO_3$), zinc oxide, cadmium sulfide, or the like is usable and a combination thereof may be used. Note that, in a case of manufacturing using photodeposition described below, the insulating fine particles 53 are required to be made from a metal oxide, an oxynitride, a nitride, or a sulfide functioning as photocatalyst and use of titanium oxide ($TiO_2$) is suitable. A crystal structure of the titanium oxide may be any of an anatase-type crystal structure, a rutile-type crystal structure, and a brookite-type crystal structure. The titanium oxide preferably has an average secondary particle diameter of 0.1 μm. to 5.0 μm and an average primary particle diameter of 1 nm to 1000 nm.

As the conductive fine particles 54, any conductor is usable as long as being able to be supported on the insulating fine particles 53, but the conductor needs to have a high resistance to oxidation for the purpose of avoiding oxidation degradation at a time of an operation under the atmospheric pressure, and is preferably metal and more preferably noble metal. Examples of the material of the conductive fine particles 54 include gold, silver, copper, rhodium, platinum, palladium, nickel, ruthenium, and cobalt. Moreover, as the material of the conductive fine particles 54, micro powder other than metal, such as fullerenes or carbon nanotubes, is also usable. A particle diameter of the conductive fine particles 54 is smaller than that of the insulating fine particles 53 and falls in a range of 3 nm to 80 nm, and preferably in a range of 5 nm to 10 nm.

Next, an example of a manufacturing process in the fourth embodiment will be indicated below. Note that, the invention is not limited thereto and a different known manufacturing method may be used.

<Insulating Layer Forming Step>

In the fourth embodiment, similarly to the first embodiment described above, the insulating layer 60 is formed on the upper surface of the substrate 30. In an insulating layer forming step, for example, when an aluminum plate is used as the substrate 30, the insulating layer 60 that is patterned to form an opening by a screen printing method as illustrated in FIGS. 2A through 2C is formed on the substrate 30. The insulating layer 60 may be formed by anodizing processing.

Specifically, an aluminum substrate with a thickness of 0.5 mm is used as the substrate 30. The aluminum substrate is anodized while masking an electron emission region of 5 mm×5 mm. Conditions of the anodizing processing are as follows: the processing is performed in a 15 wt % sulfuric acid bath at 20±1° C. and at a current density of 1 $A/dm^2$ for 250 seconds. After that, by performing sealing processing for the aluminum substrate by distilled water (pH: 6.0, 90° C.) for about 30 minutes, the insulating layer 60 with a thickness of 2 μm is formed. Note that, the sealing processing may be performed by distilled water with pH of 5.5 to 7.5 at 90 to 100° C.

<Insulating Fine Particle Applying Step>

At an insulating fine particle applying step, the insulating fine particles 53 are applied into the opening of the insulating layer 60 by using an application method such as a spin coating method, a dropping method, or a spray coating method. Specifically, $TiO_2$ particles (X-ray particle diameter: 200 nm) that are the insulating fine particles 53 are applied by a spin coating method and a film thickness is 1.3 μm.

<Conductive Fine Particle Supporting Step>

At a conductive fine particle supporting step, the support particles 55 are formed by supporting the conductive fine particles 54 on the insulating fine particles 53. As a method of supporting metal by electroless plating or reducing aqueous solution containing metal ions as the conductive fine particles 54, there are an impregnation method, a citric acid reduction method, an air reduction method, and photodeposition.

The photodeposition is used in the present embodiment and details thereof will be described. In the photodeposition, in a state where solution (reaction solution) that contains metal ions or the like related to metal to be supported is brought into contact with an insulating material having a photocatalytic function, light exerting the photocatalytic function is provided. Thereby, electrons are excited by the insulating material (including a semiconductor material), the metal ions or the like are reduced, and the metal is supported on the insulating material.

A solvent used for the reaction solution is not particularly limited as long as being a solvent by which metal ions or the like related to metal to be supported can be dissolved. However, as the metal ions are reduced to metal, an oxidation reaction that is paired with the reduction occurs with the insulating material, so that the solvent for the reaction solution is preferably a solvent that does not interfere with the reduction of the metal ions. An example of a suitable solvent for the reaction solution includes water or a mixed solvent of alcohol and water, such as methanol aqueous solution. In a case where an alcohol solvent is contained in a photocatalytic reaction, alcohol is oxidized by reaction with holes (positive holes) of a valence band of electrons (excited electrons) that are excited. When the positive holes are consumed, recombining of the excited electrons and the positive holes is suppressed and it is possible to promote a reduction reaction.

In the photodeposition, since the reaction further progresses by stirring, the photocatalytic reaction may be performed while stirring is performed. Moreover, a light source used for the photocatalytic reaction is desired to radiate light having a wavelength that enables to exert the photocatalytic function, and, for example, in a case where the insulating material is titanium oxide ($TiO_2$), an ultraviolet lamp is applied.

In the present embodiment, silver serving as the conductive fine particles 54 is supported on titanium oxide ($TiO_2$) serving as the insulating fine particles 53. The substrate 30 applied with the insulating fine particles 53 is put into a vessel into which 100 ml of aqueous silver nitrate solution with 5 μmol/L serving as reaction solution is put. In such a state, ultraviolet ray is radiated from the ultraviolet lamp that is the light source. As a result, by the photocatalytic function of the titanium oxide, silver ions are reduced on the titanium oxide and the support particles 55 supporting silver fine particles are formed. Then, the resultant is dried naturally overnight in a room temperature atmosphere and the intermediate layer 50 constituted by the support particles 55 is formed on the substrate 30.

<Second Electrode Forming Step>

At a second electrode forming step, the second electrode 40 is formed on the intermediate layer 50 and the insulating layer 60. As a method of forming the second electrode 40, for example, a vacuum deposition method or a sputtering method may be used. In a case where the second electrode 40 has two or more layers, various kinds of metal may be sequentially laminated in accordance with each of patterns. In the present embodiment, the second electrode 40 is made from Au, has a film thickness of 40 nm, and is formed by a magnetron sputtering apparatus. The second electrode 40 is provided in a range of 7 mm×7 mm, which is slightly larger than an element area (electron emission region RD).

As a result of observing a sectional surface of the electron emission element 20 created by the aforementioned method, the insulating layer thickness d1 is 4 μm, the border level difference d2 is 2 μm, and the intermediate layer film thickness d3 is 1.3 μm. Additionally, as a result of evaluating the electron emission element 20 according to the present embodiment in a similar manner to that of the first embodiment, a result indicating that both. of the emission property and the life are excellent is able to be obtained and relations of d1>d2 and d2<3×d3 are satisfied.

Next, a modified example of the fourth embodiment will be described.

Figure 12:
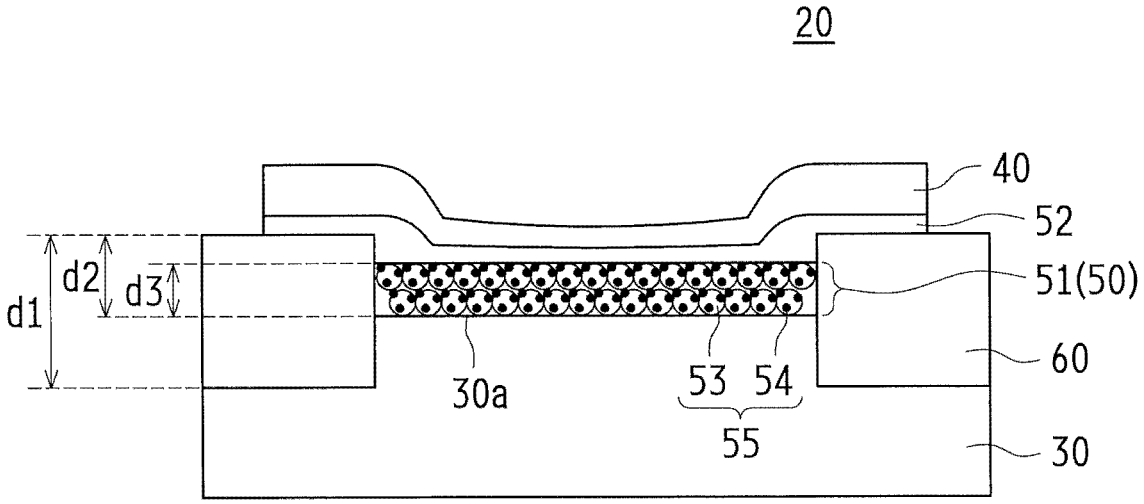
FIG. 12 is a schematic sectional view illustrating a modified example of the electron emission element according to the fourth embodiment of the invention.

FIG. 12 is a schematic sectional view illustrating a modified example of the electron emission element according to the fourth embodiment of the invention.

In the modified example, a binder layer 52 is laminated. between the fine particle layer 51 and the second electrode 40. Note that, also in the modified example, the fine particle layer 51 corresponds to the intermediate layer 50. The binder layer 52 is formed of binder resin, a material thereof is not particularly limited as long as having an insulating property, most resin is usable therefor, and silicone resin is usable, for example, and a curing type thereof is also not particularly limited. The binder layer 52 is preferably thinner than the fine particle layer 51 and a total thickness of the fine particle layer 51 and the binder layer 52 is preferably 0.3 to 5 μm. In a case where the binder layer 52 is provided, binder resin may be contained in the fine particle layer 51. Moreover, a structure is not limited to the structure illustrated in FIG. 12 and, extremely, a layer (single layer) in which the fine particle layer 51 and the binder layer 52 are mixed may be provided. That is, the structure illustrated in FIG. 11, in which the intermediate layer 50 includes the support particles 55 and the binder resin, may be provided.

In a manufacturing process of the modified example, a binder containing step is performed between the conductive fine particle supporting step and the second electrode forming step.

<Binder Containing Step>

At the binder containing step, insulating resin serving as binder is supplied onto the fine particle layer 51. Here when thicknesses of the fine particle layer 51 and the binder layer 52 are adjusted, for example, by a feeding amount or feeding method of the insulating resin, a distance between the first electrode 30*a* and the second electrode 40 is able to be adjusted. The binder layer 52 may be formed by a known method and is formed by applying silicone resin or the like, for example, with use of a spin coating method or a spray coating method and curing the resultant.

Fifth Embodiment

Figure 13:
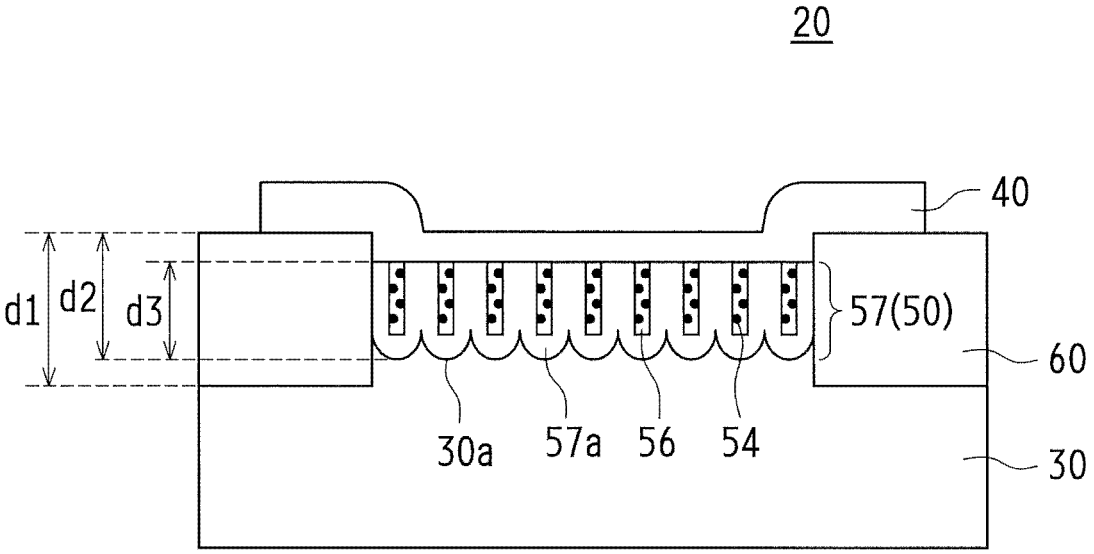
FIG. 13 is a schematic sectional view of an electron emission element according to a fifth embodiment of the invention.

FIG. 13 is a schematic sectional view of an electron emission element according to a fifth embodiment of the invention. Note that, since the fifth embodiment has an almost similar configuration to that of the first embodiment, a component having a function substantially equivalent to those of the first embodiment through the fourth embodiment will be given the same reference sign and description thereof will be omitted.

The fifth embodiment is different from the first embodiment in a configuration of the intermediate layer 50. In the present embodiment, the intermediate layer 50 is a porous alumina layer 57 having a plurality of pores 56 and the conductive fine particles 54 are supported in the pores 56.

In the present embodiment, the substrate 30 (first electrode 30*a*) is an aluminum substrate (for example, with a thickness of 0.5 mm) and the porous alumina layer 57 is an anodized layer formed on a surface of the aluminum substrate. Note that, instead of the aluminum substrate, a structure in which an aluminum layer is formed on a substrate (for example, glass substrate) may be provided, and the porous alumina layer 57 may be an anodized layer formed on a surface of the aluminum layer supported on the substrate. In this manner, in a case where the substrate 30 is an insulating substrate like a glass substrate, a conductive layer may be formed between the aluminum layer and the substrate 30 and the aluminum layer and the conductive layer may be used as the first electrode 30*a*. A thickness of the aluminum layer (remaining part after anodizing) that functions as the first electrode 30*a* is preferably, for example, 10 μm or more.

Each of the pores 56 is open at an upper surface of the porous alumina layer 57 (substrate 30) and formed to be dug toward a border between the porous alumina layer 57 and the first electrode 30*a*. The plurality of pores 56 are arranged by being dispersed in the electron emission region. The pores 56 are deep to such an extent that does not reach the first electrode 30*a*. Hereinafter, for description, out of the porous alumina layer 57, a layer that is between the pores 56 and the first electrode 30*a* and constitutes a bottom part of the porous alumina layer 57 is called a barrier layer 57*a* in some cases.

The pores 56 have an opening diameter (area equivalent circular diameter) as viewed from an upper side (second electrode 40 side) is about 50 nm or more and about 3 μm or less. Note that, the pores 56 may have different diameters in a depth direction or may have a diameter reduced toward a bottom part side. Note that, sizes of the porous alumina layer 57, the barrier layer 57*a*, and the pores 56 will be specifically described with a manufacturing method described below.

Any conductor is usable for the conductive fine particles 54 as long as being able to be supported on the alumina, and a material similar to that of the conductive fine particles 54 in the fourth embodiment described above is applicable. In the present embodiment, the conductive fine particles 54 have a particle diameter smaller than the opening diameter of the pores 56, and a range thereof is 1 nm to 80 nm and is preferably 3 nm to 10 nm. For example, in a case where silver nanoparticles (hereinafter, represented as "Ag nanopartides") are used as the conductive fine particles 54, an average particle diameter is preferably 1 nm or more and 50 nm or less, and the average particle diameter is more preferably 3 nm or more and 10 nm or less. The Ag nanoparticles may be coated with an organic compound (for example, alcohol derivative and/or surfactant).

Next, an example of a manufacturing process in the fifth embodiment will be indicated below. Note that, the invention is not limited thereto and a different known manufacturing method may be used.

In the fifth embodiment, the insulating layer 60 is formed on the upper surface of the substrate 30 similarly to the first embodiment described above.

<Porous Alumina Layer Forming Step>

At a porous alumina layer forming step, as inside of the opening of the insulating layer 60 is anodized to thereby form the porous alumina layer 57. Here, the insulating layer 60 may be protected by masking. Additionally, etching may be performed as necessary after the anodizing, and the anodizing and the etching may be alternately performed multiple times. By adjusting conditions of the anodizing and the etching, the pores 56 having various sectional shapes and sizes are formed. In FIG. 13, the pores 56 having a columnar shape are formed in the porous alumina layer 57.

In the anodizing for forming the porous alumina layer 57, for example, an aqueous solution that contains acid selected from a group consisting of oxalic acid, tartaric acid, phosphoric acid, chromic acid, citric acid, and malic acid is used as an electrolytic solution. The opening diameter, an inter-adjacent-pore distance (interval between pores 56), the depth of the pores 56, a thickness of the porous alumina layer 57, and a thickness of the barrier layer 57*a* are controlled by adjusting anodizing conditions (for example, a type of an electrolytic solution, applied voltage).

After the anodizing, the diameter of the pores 56 is able to be increased by etching, and the porous alumina layer 57 may be brought into contact with an alumina etchant. Here, in a case where wet etching is employed, a pore wall and the barrier layer 57*a* are able to be almost isotropically etched. In the wet etching, by adjusting a type and a concentration of etching solution and an etching duration, an etching amount (i.e., the opening diameter, the inter-adjacent-pore distance, the depth of the pores 56, the thickness of the barrier layer 57*a*, and the like) is able to be controlled. As the etching solution, for example, an aqueous solution of phosphoric acid, an aqueous solution of organic acid such as formic acid, acetic acid, or citric acid, or a chromium-phosphoric acid mixture solution is usable.

The porous alumina layer 57 preferably has a thickness of about 10 nm or more and about 5 μm or less regardless of a shape. When the thickness is less than 10 nm, the porous alumina layer 57 is not able to support sufficient conductive fine particles (for example, Ag nanoparticles) and desired electron emission efficiency may not be achieved. An upper limit of the thickness of the porous alumina layer 57 is not particularly limited, but when the thickness is Increased, the electron emission efficiency tends to be saturated, so that the thickness is not required to be larger than 5 μm from a viewpoint of manufacturing efficiency.

In the present embodiment, the depth of the pores 56 is 10 nm or more and 5 μm or less, but the depth may be 50 nm or more and 500 nm or less. Note that, the depth of the pores 56 may be set as appropriate in accordance with the thickness of the porous alumina layer 57.

The barrier layer 57*a* preferably has a thickness of 1 nm or more and 1 μm or less and more preferably has a thickness of 100 nm or less. In a case where the thickness of the barrier layer 57*a* is less than 1 nm, short circuit may occur during voltage application, and when the thickness is less than 1 μm, sufficient voltage may not be applied to the intermediate layer 50. The thickness of the barrier layer 57*a* generally depends on the anodizing conditions in addition to the inter-adjacent-pore distance and the opening diameter (two-dimensional size) of the pores 56.

In the present embodiment, the conditions of the anodizing processing are as follows: oxalic acid (0.05 M, 5° C.) is used and the processing is performed for about 25 minutes with formation voltage of 80 V. Then, etching is performed for 20 minutes with phosphoric acid (0.1 M, 25° C.). Thereby, the pores 56 having the depth of about 2000 nm, the opening diameter of 100 nm, and the inter-adjacent-pore distance of 200 nm are obtained. Then, the thickness of the barrier layer 57*a* is about 30 nm.

<Conductive Fine Particle Supporting Step>

At a conductive fine particle supporting step, the conductive fine particles 54 are supported in the pores 56 of the porous alumina layer 57. Specifically, dispersion liquid obtained by dispersing the conductive fine particles 54 into a dispersion medium such as an organic solvent is applied to the substrate 30 subjected to the porous alumina layer forming step.

In the present embodiment, Ag nanoparticles are used as the conductive fine particles 54, and dispersion liquid obtained by dispersing the Ag nanoparticles into an organic solvent is applied onto the porous alumina layer 57. A content of the Ag nanoparticles in the dispersion liquid is preferably 0.1 mass % or more and 10 mass % or less, and is 2 mass %, for example. In the dispersion liquid used in the present embodiment, the dispersion medium is toluene and a concentration of Ag is 1.3 mass %. Note that, hereinafter, for description, the dispersion liquid used in the present embodiment is simply abbreviated as dispersion liquid in some cases.

The Ag nanoparticles in the dispersion liquid may be coated with an organic compound, and dispersibility is thereby enhanced. The organic compound that coats the Ag nanoparticles is an alcohol derivative and/or surfactant, the alcohol derivative is, for example, alkoxide, and the surfactant is, for example, carboxylic acid and an organic substance having a derivative thereof at the terminal. The Ag nanoparticles used for the dispersion liquid have an average particle diameter of 6 nm in a state of being coated with the alcohol derivative.

A method of applying the dispersion liquid is not particularly limited, and the dispersion liquid is applied by using, for example, a spin coating method or a spray coating method and enters into the pores, so that the conductive fine particles 54 are supported. In the present embodiment, 200 μL (microliters) of the dispersion liquid described above are dropped onto the porous alumina layer 57 and spin coating is performed. Conditions of the spin coating are as follows: after rotation for 5 seconds with 500 rpm, rotation is performed for 10 seconds with 1500 rpm. The substrate 30 applied with the dispersion liquid is fired for 1 hour at 150° C. By performing a firing step in this manner, the organic substance covering the Ag nanoparticles is able to be removed or reduced. A firing temperature is preferably 100° C. to 250° C.

After the foregoing steps, the second electrode 40 is formed similarly to the second electrode forming step of the fourth embodiment described above, the electron emission element 20 according to the fifth embodiment is obtained.

As a result of observing a sectional shape of the electron emission element 20 that is created by the method described above, the insulating layer thickness d1 is 4 μm, the border level difference d2 is 3 μm, and the intermediate layer film thickness d3 is 2.03 μm. Moreover, as a result of evaluating the electron emission element 20 according to the present embodiment similarly to the first embodiment, a result indicating that both of the emission property and the life are excellent is able to be obtained and relations of d1>d2 and d2<3×d3 are satisfied.

Note that, the embodiments disclosed herein are an example in all respects and shall not serve as a basis for limited interpretation. Accordingly, the technical scope of the invention shall not be interpreted only by the aforementioned embodiments, but is defined on the basis of the description of the claims. Moreover, meanings equivalent to the claims and all modification falling in the scope of the claims are included.

Note that, this application claims the benefit of priority to Japanese Patent Application No. 2016-143060 filed on Jul. 21, 2016, the content of which is incorporated herein by reference in its entirety. Furthermore, the entire contents of a reference cited in the present specification are herein specifically incorporated by reference.

INDUSTRIAL APPLICABILITY

An electron emission element according to the invention is suitably applicable to, for example, an electrification apparatus used for an image forming apparatus, such as an electrophotographic copier, a printer, or a facsimile, an electron beam curing device, an image display device in which the electron emission element is combined with a phosphor, an ion stream generation device that uses ion. stream generated by electrons that are emitted, and the like.

REFERENCE SIGNS LIST

1 image forming apparatus
10 electrification apparatus
20 electron emission element
30 substrate
30*a* first electrode
40 second electrode
50 intermediate layer
51 fine particle layer
52 binder layer
53 insulating fine particle
54 conductive fine particle
55 support particle
56 pore
57 porous alumina layer
57*a* barrier layer
60 insulating layer
70 wire electrode
80 third electrode
d1 insulating layer thickness
d2 border level difference
d3 intermediate layer film thickness

The invention claimed is:

1. An electron emission element that applies voltage across a first electrode and a second electrode which are arranged facing each other and emits electrons from the second electrode, the electron emission element comprising:

an intermediate layer that is provided between the first electrode and the second electrode; and an insulating layer that is formed with a thickness d1 on a substrate provided with the first electrode, wherein the intermediate layer has conductive fine particles dispersed, a level difference d2 between the insulating layer and the first electrode is smaller than the thickness d1 of the insulating layer, and the insulating layer is provided in a region of the substrate, which is lower than an upper surface of the first electrode.

2. The electron emission element according to claim 1, wherein a film thickness d3 of the intermediate layer satisfies d2<3×d3.

3. The electron emission element according to claim 2, wherein the film thickness d3 of the intermediate layer satisfies 0.3 μm<d3<5 μm.

4. The electron emission element according to claim 3, wherein the substrate is formed of a metal material, and the insulating layer is an anodized film.

5. The electron emission element according to claim 4, wherein the substrate is formed of aluminum.

6. The electron emission element according to claim 4, wherein the insulating layer is formed after the substrate is subjected to surface processing.

7. The electron emission element according to claim 1, wherein a surface roughness Ra of the first electrode satisfies 0.05 μm<Ra<0.8 μm.

8. An electrification apparatus comprising the electron emission element according to claim 1 as an electron emission source.

9. An image forming apparatus comprising the electrification apparatus according to claim 8.

10. The electron emission element according to claim 1, wherein a particle diameter of the conductive fine particles is 1 nm to 80 nm.

* * * * *